US006939443B2

(12) United States Patent
Ryan et al.

(10) Patent No.: US 6,939,443 B2
(45) Date of Patent: Sep. 6, 2005

(54) ANIONIC FUNCTIONAL PROMOTER AND CHARGE CONTROL AGENT

(75) Inventors: Michael Ryan, Newtown, CT (US); William Brevard, Sr., Stamford, CT (US); David Dauplaise, Stamford, CT (US); Michael Lostocco, Appleton, WI (US); Robert Proverb, Woodbury, CT (US); David Wesley Lipp, Stamford, CT (US)

(73) Assignee: Lanxess Corporation, Pittsburgh, PA (US)

( * ) Notice: Subject to any disclaimer, the term of this patent is extended or adjusted under 35 U.S.C. 154(b) by 279 days.

(21) Appl. No.: 10/174,964

(22) Filed: Jun. 19, 2002

(65) Prior Publication Data

US 2003/0234089 A1 Dec. 25, 2003

(51) Int. Cl.[7] ..... D21H 21/20

(52) U.S. Cl. ..... 162/164.1; 162/164.3; 162/164.5; 162/164.6; 162/168.2; 162/168.3; 162/183

(58) Field of Search ..... 162/164.1, 168.2, 162/168.3, 164.3, 164.6, 164.5, 183

(56) References Cited

U.S. PATENT DOCUMENTS

| | | | | |
|---|---|---|---|---|
| 3,049,469 A | | 8/1962 | Davison | 162/164 |
| 3,816,556 A | | 6/1974 | Coscia et al. | 260/836 |
| 4,510,019 A | * | 4/1985 | Bartelloni | 162/141 |
| 4,517,285 A | | 5/1985 | Woodward et al. | 430/538 |
| 4,643,801 A | * | 2/1987 | Johnson | 162/164.1 |
| 5,155,156 A | | 10/1992 | Scanley | 524/366 |
| 5,316,623 A | | 5/1994 | Espy | 162/164.3 |
| 5,318,669 A | | 6/1994 | Dasgupta | 162/164.3 |
| 5,502,091 A | | 3/1996 | Dasgupta | 524/55 |
| 5,543,446 A | | 8/1996 | Rodriguez | 524/52 |
| 5,633,300 A | | 5/1997 | Dasgupta | 524/55 |
| 5,700,352 A | * | 12/1997 | Vinson et al. | 162/111 |
| 5,750,489 A | | 5/1998 | Garcia et al. | 510/417 |
| 5,798,023 A | * | 8/1998 | Pruszynski et al. | 162/181.1 |
| 5,824,190 A | * | 10/1998 | Guerro et al. | 162/135 |
| 5,876,563 A | * | 3/1999 | Greenwood | 162/175 |
| 6,228,217 B1 | * | 5/2001 | Dickerson et al. | 162/158 |
| 6,270,627 B1 | * | 8/2001 | Keiser et al. | 162/181.6 |
| 6,331,229 B1 | * | 12/2001 | Wong Shing et al. | 162/168.3 |
| 6,419,789 B1 | * | 7/2002 | Yeh et al. | 162/109 |
| 6,706,146 B2 | * | 3/2004 | Matsumoto | 162/145 |

FOREIGN PATENT DOCUMENTS

| | | |
|---|---|---|
| EP | 0790351 | 8/1997 |
| EP | 0835957 | 4/1998 |
| EP | 1180559 | 2/2002 |
| WO | 0177437 | 10/2001 |

OTHER PUBLICATIONS

Zhongguo Zaozhi, (month unavailable) 1997, 16(1), pp. 34–38, "Study of the Co–use Technology of Polyamide Polyamide Epichlorhydrin Resin with Anionic Polymer to Kraft Reed Pulp". Zhan Huaiyu, Wu Jiaoping and Yue Baozhen (see translation attached).

Wochenbl. Ppierfabr, (month unavailable) 1988, 116 (16), kpages 649–660, J. Weigl, M. Cordes–Tolle, "Possible improvement of dry and wet strength charateristic withing the neutral Ph range".

* cited by examiner

*Primary Examiner*—Peter Chin
(74) *Attorney, Agent, or Firm*—Godfried R. Akrli; Diderico van Eyl

(57) ABSTRACT

The invention relates to a functional promoter comprising a water-soluble anionic polymer having a molecular weight of at least about 50,000 daltons and a molecular weight charge index value of at least about 10,000, and a cationic strength component. The invention also relates to a paper product made with such a system, and method for imparting wet strength to a paper product with the functional promoter.

33 Claims, No Drawings

ANIONIC FUNCTIONAL PROMOTER AND CHARGE CONTROL AGENT

BACKGROUND

The papermaking industry has for some time needed a better way to enhance the wet strength of paper products. The commercial importance of paper products such as paper board, fine paper, newsprint, tissue and towel has fueled a need for improved compositions and methods that enhance the wet strength of paper products.

Known information offers limited choices having technical and economic disadvantages. It is known that carboxymethylcellulose, for instance, can be used to promote the wet strength imparting capacity of polyamide resins. However, the use of carboxymethylcellulose has several disadvantages. For instance, carboxymethylcellulose is a dry material, which makes it difficult to work with and requires special make-down equipment. Carboxymethylcellulose often requires applications at significant dosages. Also, carboxymethylcellulose can be an explosion hazard under certain conditions, and thereby can be a hazardous and dangerous material.

U.S. Pat. No. 3,049,469 teaches adding dilute aqueous solutions of a cationic resin and a water-soluble, carboxyl-containing material (an acrylic dry strength additive) to a dilute aqueous suspension of a paper pulp. The patent broadly teaches that sheeting and drying the pulp forms a paper product that exhibits enhanced dry and wet strength properties. The patent also broadly teaches that the improvement in wet strength is greater than would be expected from the combined action of the ingredients, thus indicating a synergistic effect when the two components are used together.

Unfortunately, the teachings of U.S. Pat. No. 3,049,469 are so broad and general that in describing suitable carboxyl-containing materials, the patent does not emphasize which features, if any, of carboxyl-containing materials may critically affect their performance. The single example provided by the patent does not indicate the molecular weight or the charge of the acrylamide-acrylic acid copolymer that is mentioned. The patent does not provide any guidelines about which carboxyl-containing materials may be unsuitable. The patent does not provide any guidelines about how the molecular weight of anionic polymers and the charge properties of anionic polymers may affect the performance of wet strength agents.

Huaiyo et al., *Study of the Co-Use Technology of Polyamide Polyamine Epichlorohydrin Resin with Anionic Polymer to Kraft Reed Pulp* Zhongguo Zaozhi (1997), 16(1), pp. 34–38 discloses in part that a polyamide polyamine epichlorohydrin resin used in combination with a polyacrylamide having a molecular weight of more than five million daltons can improve dry and wet strength of paper. Huaiyo, however, does not provide any guidelines about how the molecular weight and the charge properties of anionic polymers may affect the performance of wet strength agents. The high molecular weight polymers disclosed by the article are commercially disadvantageous. Such high molecular weight polymers, for instance, flocculate the sheets causing poor formation of paper. Also, it is known that when a polymer having such a high a molecular weight is used in solution, the solution must have impractically low solids contents in order to maintain acceptable flow properties.

The above-mentioned deficiencies and disadvantages are typical in the literature. Indeed, the art is replete with information that does not provide meaningful guidelines about which features, if any, of carboxyl-containing materials are critical, in imparting wet strength to paper products. The literature does not provide any meaningful guidelines that would enable an artisan to develop a method that enhances the wet strength-enhancing properties of a cationic strength agent without requiring increased amounts of materials.

For the foregoing reasons, there is a need for better methods to enhance the wet strength of paper products.

For the foregoing reasons, there is a need for improved compositions for making paper products having enhanced wet strength.

For the foregoing reasons, there is a need for compositions and methods that can promote the wet strength-enhancing properties of a cationic strength agent without requiring increased amounts of the wet strength agent or the carboxyl-containing material.

SUMMARY

The invention relates to a functional promoter comprising a water-soluble anionic polymer having a molecular weight of at least about 50,000 daltons and a molecular weight charge index value (defined below) of at least about 10,000.

In one embodiment, the invention relates to a functional promoter comprising a water-soluble anionic polymer having a molecular weight ranging from about 50,000 daltons to about 500,000 daltons and a molecular weight charge index value that is more than 10,000 and less than 500,000.

The invention also relates to a paper product comprising the reaction product of (a) a cationic strength component, (b) a fibrous substrate component, and (c) a functional promoter comprising a water-soluble anionic polymer having a molecular weight that is at least 50,000 daltons and a molecular weight charge index value that is at least about 10,000.

The invention also relates to a method for making a paper product comprising adding to a pulp slurry containing a fibrous substrate component a composition comprising (a) a functional promoter comprising a water-soluble anionic polymer having a molecular weight that is at least 50,000 daltons and a molecular weight charge index value that is more than 10,000, and (b) a cationic strength component.

These and other features, aspects, and advantages of the present invention will become better understood with reference to the following description and appended claims.

DESCRIPTION

The invention is based on the discovery that the wet strength of a paper product can be unexpectedly improved by using a cationic strength agent in conjunction with a specific water-soluble anionic polymer having certain molecular weight and charge properties, referred to herein as a "functional promoter." Remarkably, by varying the charge properties of an anionic polymer, the invention can promote the wet strength-enhancing properties of a cationic strength agent without requiring increased amounts of the wet strength agent or the anionic polymer. Also, the invention is based on the discovery that anionic polymers having specific molecular weight and charge properties function exceptionally well in applications involving cationic strength polymers and anionic polymers under certain conditions.

The functional promoter is generally a water-soluble anionic polymer or a water-dispersible polymer having a molecular weight that is at least about 50,000 daltons and a molecular weight charge index value that is at least about 10,000. As used herein, the term "charge" refers to the molar weight percent of anionic monomers in a functional promoter. For instance, if a functional promoter is made with 30 mole % anionic monomer, the charge of the functional promoter is 30%. The phrase "molecular weight charge index value" means the value of the multiplication product of the molecular weight and the charge of a functional promoter. For instance, a functional promoter having a molecular weight of 100,000 daltons and a charge of 20% has a molecular weight charge index value that is 20,000. All molecular weights discussed herein are weight average molecular weights. The average molecular weight of a functional promoter can be measured by size exclusion chromatography. When the functional promoter is used in conjunction with a cationic strength agent, the resulting composition imparts improved wet strength to paper products as compared to when the cationic strength agent is used in conjunction with a water-soluble anionic polymer that does not have a molecular weight that is at least about 50,000 daltons and a molecular weight charge index value that is at least about 10,000.

Examples of suitable anionic polymers having a molecular weight that is at least about 50,000 daltons and a molecular weight charge index value that is at least about 10,000 include specific anionic water-soluble or water-dispersible polymers and copolymers of acrylic acid and methacrylic acid, e.g., acrylamide-acrylic acid, methacrylamide-acrylic acid, acrylonitrile-acrylic acid, methacrylonitrile-acrylic acid, provided, of course, that the polymers meet the required molecular weight and molecular weight charge index value. Other examples include copolymers involving one of several alkyl acrylates and acrylic acid, copolymers involving one of several alkyl methacrylates and acrylic acid, anionic hydroxyalkyl acrylate or hydroxyalkyl methacrylate copolymers, copolymers involving one of several alkyl vinyl ethers and acrylic acid, and similar copolymers in which methacrylic acid is substituted in place of acrylic acid in the above examples, provided, of course, that the polymers meet the required molecular weight and molecular weight charge index value. Other examples of suitable anionic polymers having a molecular weight that is at least about 50,000 daltons and a molecular weight charge index value that is at least about 10,000 include those anionic polymers made by hydrolyzing an acrylamide polymer or by polymerizing monomers such as (methyl) acrylic acid and their salts, 2-acrylamido-2-methylpropane sulfonate, sulfoethyl-(meth)acrylate, vinylsulfonic acid, styrene sulfonic acid, maleic or other dibasic acids or their salts or mixtures thereof. Additionally, crosslinking agents such as methylene bisacrylamide may be used, provided, of course, that the polymers meet the above-mentioned molecular weight and molecular weight charge index value.

The functional promoter is made by polymerizing anionic monomers, and non-ionic monomers in the presence of an initiator component and a suitable solvent component under conditions that produce an anionic polymer having a molecular weight that is at least about 50,000 daltons and a molecular weight charge index value that is at least about 10,000. During the preparation of the functional promoter, it is critical that the charge and the molecular weight be controlled so that the resulting polymer has a proper molecular weight and a proper molecular weight charge index value. The charge of the anionic polymer is generally controlled by adjusting the ratios of the anionic monomers and the non-ionic monomers. The molecular weight of the anionic polymer, on the other hand, is adjusted by adjusting the polymerization initiator or a chain-transfer agent.

The way the initiator system is adjusted will depend on the initiator system that is used. If a redox-based initiator is used, for instance, the initiator system is adjusted by adjusting the ratio and the amount of initiator and a co-inititator. If an azo-based initiator system is used, adjustment of the azo-compound will determine the molecular weight of the anionic polymer. Alternatively, a chain transfer agent can be used in conjunction with a redox-based initiator or an azo-based initiator to control the molecular weight of the anionic polymer. Provided that the monomers and inititator components are adjusted to make an anionic polymer having the required molecular weight and molecular weight charge index value, known methods for making acrylic-acrylamide polymers can be modified accordingly to make the functional promoter.

The molecular weight of the functional promoter can differ. In one embodiment, the functional promoter has a molecular weight ranging from about 50,000 to about 5,000,000 daltons, or from about 50,000 to about 4,000,000 daltons, or from about 50,000 to about 3,000,000 daltons, or from about 50,000 to about 2,000,000 daltons, or from about 50,000 to about 1,500,000 daltons, or from about 50,000 to about 1,000,000 daltons. In one embodiment, the functional promoter has a molecular weight ranging from about 50,000 to about 750,000 daltons. In another embodiment, the functional promoter has a molecular weight ranging from about 50,000 to about 650,000 daltons. In another embodiment, the functional promoter has a molecular weight ranging from about 50,000 to about 500,000 daltons. In another embodiment, the functional promoter has a molecular weight ranging from about 300,000 to about 500,000 daltons. In another embodiment, the functional promoter has a molecular weight ranging from about 50,000 to about 250,000 daltons. In another embodiment, the functional promoter has a molecular weight ranging from about 50,000 to about 100,000 daltons. When the functional polymer is in solution, the molecular weight of the functional promoter is preferably less than 5,000,000 daltons.

Similarly, the molecular weight charge index value of the functional promoter can differ. In one embodiment, the functional promoter has a molecular weight charge index value ranging from about 10,000 to about 1,000,000. In another embodiment, the functional promoter has a molecular weight charge index value ranging from about 10,000 to about 500,000. In another embodiment, the functional promoter has a molecular weight charge index value ranging from about 10,000 to about 450,000. In another embodiment, the functional promoter has a molecular weight charge index value ranging from about 10,000 to about 300,000. In another embodiment, the functional promoter has a molecular weight charge index value ranging from about 10,000 to about 150,000. In another embodiment, the functional promoter has a molecular weight charge index value ranging from about 25,000 to about 100,000. In one embodiment, the charge is of the functional promoter is at least 50%.

When used in an aqueous solution, the functional promoter generally has a viscosity that is less than 2,500 cP and more than 25 cP when the solution has a concentration of 15% by weight of the functional promoter. The polymer solution was diluted to 15% using deionized water. The viscosity was then measured using a Brookfield DVII instrument with spindle #2 at 12 rpm at 25° C.

The cationic strength component includes a cationic resin, which when used in conjunction with the functional promoter, has an improved wet strength-imparting capacity, as compared to when the cationic strength agent is used in conjunction with a water-soluble anionic polymer that does not have a molecular weight that is at least about 50,000 daltons and does not have a molecular weight charge index value that is more than 10,000.

The cationic strength component can include any polyamide wet strength resin, which when used in conjunction with a functional promoter, exhibits increased wet-strength imparting properties. Useful cationic thermosetting polyamide-epichlorohydrin resins include a water-soluble polymeric reaction product of epichlorohydrin and a polyamide derived from a polyalkylene polyamine and a $C_3$–$C_{10}$ saturated aliphatic dicarboxylic acid, an aromatic dicarboxylic acid, oxalic acid, or urea. In the preparation of these cationic thermosetting resins, the dicarboxylic acid first reacts with the polyalkylene polyamine under conditions that produce a water-soluble polyamide containing the recurring groups:

$$—N(CH_2—CH_2—NH]_n—CORCO]_x,$$

in which n and x are each 2 or more and R is the divalent hydrocarbon radical of the dicarboxylic acid. This water-soluble polyamide then reacts with epichlorohydrin to form the water-soluble cationic thermosetting resin.

Other patents teaching the preparation and/or use of aminopoly-amide-epichlorohydrin resins in wet strength paper applications include U.S. Pat. Nos. 5,239,047, 2,926,154, 3,049,469, 3,058,873, 3,066,066, 3,125,552, 3,186,900, 3,197,427, 3,224,986, 3,224,990, 3,227,615, 3,240,664, 3,813,362, 3,778,339, 3,733,290, 3,227,671, 3,239,491, 3,240,761, 3,248,280, 3,250,664, 3,311,594, 3,329,657, 3,332,834, 3,332,901, 3,352,833, 3,248,280, 3,442,754, 3,459,697, 3,483,077, 3,609,126 , and 4,714,736; British patents 1,073,444 and 1,218,394; Finnish patent 36,237 (CA 65: 50543d); French patent 1,522,583 (CA 71: 82835d); German patents 1,906,561 (CA 72: 45235h), 2,938,588 (CA 95: 9046t), 3,323,732 (CA 102: 151160c); Japanese patents 70 27,833 (CA 74: 4182m), 71 08,875 (CA 75: 49990k), 71 12,083 (CA 76: 115106a); 71 12,088 (CA 76: 115107b), 71 36,485 (CA 77: 90336f); Netherlands application 6,410,230 (CA 63: P5858h); South African patent 68 05,823 (CA 71: 114420h); and Swedish patent 210,023 (CA 70: 20755y).

Other suitable cationic strength agents include cationic polyvinyl-amides suitable for reaction with glyoxal, including those which are produced by copolymerizing a water-soluble vinylamide with a vinyl, water-soluble cationic monomer when dissolved in water, e.g., 2-vinylpyridine, 2-vinyl-N-methylpyridinium chloride, diallyidimethylammonium chloride, (p-vinylphenyl)-trimethylammonium chloride, 2-(dimethylamino)ethyl acrylate, methacrylamide propyl trimethyl ammonium chloride, and the like.

Alternatively, glyoxylated cationic polymers may be produced from non-ionic polyvinylamides by converting part of the amide substituents thereof (which are non-ionic) to cationic substituents. One such polymer can be produced by treating polyacrylamide with an alkali metal hypohalite, in which part of the amide substituents are degraded by the Hofmann reaction to cationic amine substituents (see U.S. Pat. No. 2,729,560). Another example is the 90:10 molar ratio acrylamide; p-chloromethylstyrene copolymer which is converted to a cationic state by quaternization of the chloromethyl substituents with trimethylamine. The trimethylamine can be replaced in part or in whole with triethanolamine or other water-soluble tertiary amines. Alternatively still, glyoxylated cationic polymers can be prepared by polymerizing a water-soluble vinyl tertiary amine (e.g., dimethylaminoethyl acrylate or vinylpyridine) with a water-soluble vinyl monomer copolymerizable therewith, e.g., acrylamide, thereby forming a water-soluble cationic polymer. The tertiary amine groups can then be converted into quaternary ammonium groups by reaction with methyl chloride, dimethyl sulfate, benzyl chloride, and the like, in a known manner, and thereby producing an enhancement of the cationic properties of the polymer. Moreover, polyacrylamide can be rendered cationic by reaction with a small amount of glycidyl dimethyl-ammonium chloride.

The functional promoter and the cationic strength component are used in amounts sufficient to enhance the wet strength of a paper product. The specific amount and the type of the functional promoter and the cationic strength component will depend on, among other things, the type of pulp properties. The ratio of the functional promoter to the cationic strength component may range from about 1/20 to about 1/1, preferably from about 2/1 to about 1/10, and more preferably about 1/4.

The fibrous substrate of the invention can include any fibrous substrate of a pulp slurry used to make paper products. Generally, the invention can be used in slurries for making dry board, fine paper, towel, tissue, and newsprint products. Dry board applications include liner board, medium board, bleach board, and corrugated board products.

The paper products produced according to the invention may contain known auxiliary materials that can be incorporated into a paper product such as a paper sheet or a board by addition to the pulp at the wet end, directly to the paper or board or to a liquid medium, e.g., a starch solution, which is then used to impregnate a paper sheet or a board. Representative examples of auxiliary agents include defoamers, bacteriocides, pigments, fillers, and the like.

In use, the invention provides a method for imparting wet strength to a paper product. The method involves adding a wet-strength-enhancing amount of a functional promoter comprising a water-soluble anionic polymer having a molecular weight that is at least about 50,000 daltons and a molecular weight charge index value that is at least about 10,000 to a pulp slurry. The cationic strength component and the functional promoter each are generally added to a dilute aqueous suspension of paper pulp and the pulp is subsequently sheeted and dried in a known manner. Preferably, the cationic strength component and the functional promoter are added in dilute aqueous solutions. More particularly, the cationic strength component and the functional promoter are desirably added to the slurry in the form of dilute aqueous solutions at solids concentrations that are at least about 0.2%, preferably from about 1.5 to about 0.5%. The cationic strength component is generally added before the functional promoter, but it does not have to be. The papermaking system (pulp slurry and dilution water) may be acidic, neutral or alkaline. The preferred pH range is from about 4.5 to 8. The cationic strength agent can be used with cationic performance agents such as cationic starch.

The dosages at which the functional promoter and the cationic strength component are added varies, depending on the application. Generally, the dosage of the functional promoter will be at least about 0.1 lb/ton (0.005 wt %). The functional promoter dosage can range from about 0.1 lb/ton (0.005 wt %) to about 20 lbs/ton (1 wt %), or from about 3 lbs/ton (0.15 wt %) to about 20 lbs/ton (0.75 wt %), or from about 4 lbs/ton (0.2 wt %) to about 20 lbs/ton (1 wt %), or from about 2 lbs/ton (0.1 wt %) to about 5 lbs/ton (0.25 wt %). The dosage at which the cationic strength component is added is generally at least 0.1 lb/ton (0.005 wt %). The cationic strength component dosage can range from about 0.1 lb/ton (0.005 wt %) to about 100 lbs/ton (5 wt %), or from about 5 lbs/ton (0.25 wt %) to about 50 lbs/ton (2.5 wt %), or from about 10 lbs/ton (0.5 wt %) to about 30 lbs/ton (1.5 wt %), or from about 10 lbs/ton (0.5 wt %) to about 24 lbs/ton (1.2 wt %).

It is not understood why the functional promoter is effective. Without being bound by theory, it is speculated that the charge on cellulose fiber is critical in determining the effectiveness of the polyamide wet strength agent. It is also speculated that when the anionic promoter is added to the pulp slurry (furnish), the fiber charge is made anionic making it more receptive to additional cationic strength agent. It is further speculated that an anionic polymer having a molecular weight and a molecular weight charge index value in accordance with the functional promoter of the invention is relatively more physically compatible with the furnish (structurally superior), under conditions in which the cationic strength component is used.

The invention provides valuable benefits to the industry. This invention, depending on the application, can provide exceptional wet tensile strength value to a paper product. The invention can also allow for the use of lower polyamide resin dosages, thereby decreasing undesirable volatile organic compound (VOC) and dichloropropanol (DCP) levels. The effectiveness of the functional promoter substantially reduces or eliminates the need to use carboxymethylcellulose, and thereby avoids the disadvantages of using carboxymethylcellulose. The functional promoter is synthetic and, therefore, the charge and molecular weight are controllable. Also, it is a "pump-and-go" solution, and thereby is a flexible practical solution. The invention can also be effective at a lower dose than carboxymethylcellullose and is a more effective charge control agent. Although the invention is useful in imparting wet strength to paper products, the invention can also impart dry strength to paper products.

The invention is further described in the following illustrative examples in which all parts and percentages are by weight unless otherwise indicated.

EXAMPLES

Example 1

Preparation of a Poly (acrylamide$_{50}$-co-acrylic acid$_{50}$)

28.93 parts acrylic acid, 53.15 parts acrylamide (53.7% solution in water), 0.06 parts ethylenediaminetetraacetic acid disodium salt, and 17.9 parts water were charged to vessel "A" and agitated. The pH of the resulting mixture was adjusted to pH 4.0 using caustic soda. 0.28 parts ammonium persulfate in water solution were charged to vessel "B" and 0.84 parts sodium metabisulfite in water solution were charged to vessel "C." 119.76 parts water were charged to a reactor heel and agitated. The heel was brought to reflux and vessels A, B and C were charged to the reactor continuously over a 72-minute period. The reflux was continued for 30 minutes after the charges were completed. The molecular weight of the polymer was approximately 111,000 daltons. The charge of the polymer was approximately 50%.

Example 2

Preparation of a Glyoxalated Poly (acrylamide-co-acrylic acid)

100.00 parts polymer solution from Example 1 were charged to a reaction vessel and agitated. 18.85 parts glyoxal (40% solution, in water) and 64.60 parts water were charged to a reaction vessel and the pH was adjusted to 8.5 using caustic soda. When the viscosity of the solution reached 26–28 seconds in a #3 Shell cup, the reaction was quenched with sulfuric acid to pH 2.9–3.1. The charge of the polymer was approximately 50%.

Example 3

Preparation of Glyoxalated Acrylamide-Itaconic Acid-Diallyldimethyl Ammonium Chloride Terpolymers 100 parts acrylamide (52.7%), 10.6 parts itaconic acid (99%), 3.13 parts diallyldimethylammonium chloride (58.5%) were charged to a first vessel. Water was then charged to the first reaction vessel and the solution was diluted to 26% solids, and the solution was then agitated and sparged with nitrogen. 5.69 parts 2-mercaptoethanol (98%) were charged to the first reaction vessel and agitated. 9.32 parts ammonium persulfate (13.3%) were charged into the first vessel and maintained at a temperature of 70° C. 29.1 parts each of ammonium persulfate and sodium metabisulfite (2%) solutions were charged to the first vessel over one hour. The mixture was heated for one hour after completion. 150 parts of this polymer backbone was then charged to a second reaction vessel and agitated. 58.1 parts water and 32.7 parts glyoxal (40%) were charged to the second reaction vessel. The pH was adjusted to 8.3 using caustic soda. At a Shell cup viscosity of 26–27 seconds, the pH was reduced to 2.9–3.1 using sulfuric acid.

Examples 4–16

Wet Strength Evaluation

To evaluate the wet strength of a cationic strength component without use of a functional promoter in accordance to the invention, the following procedure was practiced. 1667 g of 0.6% consistency 50/50 hardwood/softwood furnish containing 200 ppm sulfates and 50 ppm calcium was adjusted to pH 7.5 using sodium hydroxide. A dilute solution of polyamide resin was mixed into the pulp slurry at the dosage level of 10 lbs/ton (0.5 wt %) for 30 seconds. To evaluate the wet tensile strength of the paper product formed, three 2.8 g handsheets, each approximately a square having an edge of 8 inches, 64 square inches (416 cm$^2$), were formed from each batch using a Noble & Wood handsheet former. The formed sheets were pressed between felts in the nip of press rolls, and then drum dried on a rotary drier for one minute at 240° F. (116° C.). The sheets were conditioned at 73° F. (23° C.) and 50% relative humidity before measuring the wet tensile using a Thwing-Albert tensile tester. The wet tensile strength of the paper was determined.

To evaluate how a functional promoter with different molecular weight and charge properties would impact the wet strength of the paper product, the procedure described above was repeated, except that dilute solutions containing anionic polymers indicated below in Tables 1 and 2 were added for 30 seconds after the polyamide resin was added. Each anionic polymer was prepared using the same general procedure as in Example 1, and the monomer and catalyst ratios were adjusted as appropriate to produce an anionic polymer having the desired molecular weight and molecular weight charge index value.

Table 1 below indicates the dosages of the cationic strength agent (PAE), the anionic polymer and the molecular weight (MW) of the anionic polymers for Examples 4–16. The dosages are given in (lbs/ton) and (weight %).

TABLE 1

| Example | Dose of PAE lbs/ton (wt %) | Dose of Anionic Polymer lbs/ton (wt %) | Anionic Polymer (MW) |
|---|---|---|---|
| 4 | 10 (.5) | 0 | N/A* |
| 5 | 10 (.5) | 2 (.1) | 5,000 |
| 6 | 10 (.5) | 2 (.1) | 10,000 |
| 7 | 10 (.5) | 2 (.1) | 250,000 |
| 8 | 10 (.5) | 3 (.15) | 5,000 |
| 9 | 10 (.5) | 3 (.15) | 10,000 |
| 10 | 10 (.5) | 3 (.15) | 250,000 |
| 11 | 10 (.5) | 4 (.2) | 5,000 |
| 12 | 10 (.5) | 4 (.2) | 10,000 |
| 13 | 10 (.5) | 4 (.2) | 250,000 |
| 14 | 10 (.5) | 5 (.25) | 5,000 |
| 15 | 10 (.5) | 5 (.25) | 10,000 |
| 16 | 10 (.5) | 5 (.25) | 250,000 |

*Not Applicable

Table 2 summarizes the anionic polymer charge, the molecular weight index value, the wet tensile strength, and the wet strength enhancement that was achieved in Examples 4–16:

TABLE 2

| Example | Anionic Polymer Charge mole % | MW Charge Index Value | Wet Tensile Strength | Wet Strength Enhancement % |
|---|---|---|---|---|
| 4 | N/A | N/A | 3.90 | N/A |
| 5 | 8 | 400 | 3.84 | −2 |
| 6 | 70 | 7000 | 3.79 | −3 |
| 7 | 8 | 20,000 | 4.30 | 10 |
| 8 | 8 | 400 | 3.95 | 1 |
| 9 | 70 | 7,000 | 3.28 | −16 |
| 10 | 8 | 20,000 | 4.20 | 8 |
| 11 | 8 | 400 | 4.07 | 4 |
| 12 | 70 | 7,000 | 3.56 | −9 |
| 13 | 8 | 20,000 | 4.44 | 14 |
| 14 | 8 | 400 | 3.90 | 0 |
| 15 | 70 | 7,000 | 3.46 | −11 |
| 16 | 8 | 20,000 | 4.21 | 8 |

The results indicated that, for a given trial at each specified dose, the trials in which a water-soluble anionic polymer having a molecular eight of at least 50,000 daltons and a molecular weight charge index value that was more than 10,000 (functional promoter) exhibited better results than those systems that used a water-soluble anionic polymer having a molecular weight that was less than 50,000 daltons and a molecular weight charge index value that was less than 10,000. In fact, the low molecular weight anionic polymers (5,000–10,000 daltons) across a range of charges yielded poor promotion and in some cases even had negative impact on wet strength. In view of what is known in the art, such results would not have been expected.

Examples 17–23

1667 g of 0.6% consistency 50/50 hardwood/softwood furnish containing 200 ppm sulfates and 50 ppm calcium was adjusted to a pH of 7.5 using sodium hydroxide. A dilute solution of polyamide resin was mixed into the pulp slurry at a dosage level of 16 lbs/ton (0.8 wt %) for 30 seconds.

To evaluate the wet tensile strength of the paper product formed, three 2.8 g handsheets, each approximately 64 square inches (416 $cm^2$), were formed from each batch using a Noble & Wood handsheet former. The formed sheets were pressed between felts in the nip of press rolls, and then drum dried on a rotary drier for one minute at 240° F. (116° C.). The sheets were conditioned at 73° F. (23° C.) and 50% relative humidity before measuring the wet tensile with a Thwing-Albert tensile tester. The wet tensile strength of the paper was determined.

To evaluate the effect of adding functional promoters having different molecular weights and different molecular weight charge index values, the procedure described above was repeated, except that dilute solutions containing the anionic polymer indicated below were added for 30 seconds after the polyamide resin was added.

The anionic polymer was prepared using the same general procedure as in Example 1, and the monomer and initiator ratios were adjusted as appropriate to produce an anionic polymer having a desired molecular weight and molecular weight charge index value.

Table 3 below summarizes the dosages of the cationic strength agent (PAE), the anionic polymer and the molecular weight (MW) of the anionic polymers for Examples 17–23. The dosages are given in (lbs/ton) and weight %.

TABLE 3

| Example | Dose of PAE lbs/ton (wt %) | Dose of anionic polymer lbs/ton (wt %) | Anionic Polymer (MW) |
|---|---|---|---|
| 17 | 16 (.8) | 0 | N/A |
| 18 | 16 (.8) | 4 (.2) | 50,000 |
| 19 | 16 (.8) | 4 (.2) | 50,000 |
| 20 | 16 (.8) | 4 (.2) | 100,000 |
| 21 | 16 (.8) | 4 (.2) | 100,000 |
| 22 | 16 (.8) | 4 (.2) | 200,000 |
| 23 | 16 (.8) | 4 (.2) | 200,000 |

Table 4 summarizes the anionic polymer charge, the molecular weight index value, the wet tensile strength, and the wet strength enhancement that was achieved in Examples 17–23:

TABLE 4

| Example | Anionic Polymer (Charge) mole % | MW Charge Index Value | Wet Tensile | Wet Strength Enhancement % |
|---|---|---|---|---|
| 17 | N/A | N/A | 3.69 | 0 |
| 18 | 20 | 10,000 | 4.11 | 11 |
| 19 | 50 | 25,000 | 4.43 | 20 |
| 20 | 20 | 20,000 | 4.27 | 16 |
| 21 | 50 | 50,000 | 4.55 | 23 |
| 22 | 20 | 40,000 | 4.51 | 22 |
| 23 | 50 | 100,000 | 4.49 | 22 |

These examples show that the system in which the polymer having an average molecular weight of at least about 50,000 daltons and a molecular weight charge index value of more than 10,000 (functional promoter) imparted significantly more wet strength than the system in which no functional promoter was used. Remarkably, when the molecular weight of the anionic polymer was approximately 50,000, the wet strength enhancement nearly doubled when the charge of the anionic polymer was increased from 20 to 50 mole %.

Examples 24–27

Promotion of Polyamide with Glyoxalated Poly (acrylamide-co-acrylic acid)

This example shows glyoxalated poly(acrylamide-co-acrylic acid) functional promoters of a specified charge enhancing the wet-strength properties of a polyamide resin. The polymers were prepared using the same general procedure as in Example 2, adjusting the monomer and initiator ratios as appropriate to obtain the charge % indicated below in Tables 5 and 6. Backbone molecular weight prior to glyoxylation was approximately 30,000 daltons in these examples. Post-glyoxalation molecular weights were much higher, approximately 1,500,000 daltons. Promotion studies were completed in handsheets using 50/50 hardwood/softwood furnish at a pH of 7.5 and a basis weight of 50 lb/ton.

Polyamide wet strength agent was promoted using a glyoxalated poly (acrylamide-co-acrylic acid) copolymer of a specified charge.

Table 5 below indicates the dosages of the cationic strength agent (PAE), the anionic polymer and the molecular weight (MW) of the anionic polymers for Examples 24–27. The dosages are given in lbs/ton and weight %(wt %).

TABLE 5

| Example | Dosage of PAE lbs/ton (wt %) | Dosage of Anionic Polymer lbs/ton (wt %) | Anionic Polymer (MW) |
|---|---|---|---|
| 24 | 20 (1) | 0 | N/A |
| 25 | 16 (.8) | 4 (.2) | 1,500,000 |
| 26 | 16 (.8) | 4 (.2) | 1,500,000 |
| 27 | 16 (.8) | 4 (.2) | 1,500,000 |

Table 6 summarizes the anionic polymer charge, the molecular weight index value, and the wet strength enhancement that was achieved in Examples 24–27:

TABLE 6

| Example | Anionic Polymer Charge Mole % | MW Charge Index Value | Wet tensile strength | Wet Strength Enhancement (%) |
|---|---|---|---|---|
| 24 | N/A | N/A | 3.53 | 0 |
| 25 | 10 | 150,000 | 3.76 | 7 |
| 26 | 20 | 300,000 | 4.07 | 15 |
| 27 | 30 | 450,000 | 4.07 | 15 |

The data above shows glyoxalated anionic polyacrylamide functional promoters effectively promoting the strength-enhancing properties of polyamide wet strength agents. When the charge of the anionic polymer increased from 10 to 20 or 30%, respectively, the wet strength enhancement to the paper more than doubled.

Although the present invention has been described in detail with reference to certain preferred versions thereof, other variations are possible. Therefore, the spirit and scope of the appended claims should not be limited to the description of the versions contained therein.

What is claimed is:

1. A composition comprising a wet-strength enhancing amount of (a) a functional promoter comprising a water-soluble anionic polymer having a molecular weight ranging from at least about 50,000 daltons to about 500,000 daltons and a molecular weight charge index value of at least about 10,000, and (b) polyamide strength resin component;

wherein when functional promoter is used in conjunction with the polyamide strength resin component in a pulp slurry during a papermaking process, the resulting composition imparts improved wet strength to a paper product made by the papermaking process as compared to when the polyamide strength resin component is used in conjunction with a water-soluble anionic polymer that does not have a molecular weight that is at least about 50,000 daltons and a molecular weight charge index value that is at least about 10,000.

2. The composition of claim 1, wherein the functional promoter has a molecular weight ranging from about 50,000 to about 250,000 daltons.

3. The composition of claim 1, wherein the functional promoter has a molecular weight ranging from about 50,000 to about 100,000 daltons.

4. The composition of claim 1, wherein the functional promoter has a molecular weight ranging from about 300,000 to about 500,000.

5. The composition of claim 1, wherein the functional promoter has a molecular weight charge index value ranging from about 10,000 to about 100,000.

6. The composition of claim 1, wherein the functional promoter has a molecular weight charge index value ranging from about 25,000 to about 100,000.

7. The composition claim 1, wherein the functional promoter is in solution.

8. The composition of claim 1, wherein the functional promoter is selected from the group consisting of copolymers of acrylamide-acrylic acids, copolymers of methacrylic acid, copolymers having alkyl acrylates and acrylic acid, copolymers of alkyl methacrylates and acrylic acid, anionic hydroxyalkyl acrylate copolymers, hydroxy alkyl methacrylate copolymers, copolymers of alkyl vinyl ethers and acrylic acid, anionic polymers made by hydrolyzing an acrylamide polymer, anionic polymers made by polymerizing (i) (methyl)acrylic acid, (II) (methyl)acrylic acid salts, (iii) 2-acrylamido-2-methylpropane sulfonate, (iv) sulfoethyl-(meth)acrylate,(iv) vinylsulfonic acid, (v) styrene sulfonic acid, (vi) dibasic acids, (vii) salts of the foregoing monomers, and mixtures thereof, and anionic polymers made with crosslinking agents.

9. The composition of claim 1, wherein the composition further comprises a fibrous substrate component.

10. The composition of claim 9, wherein the fibrous substrate component is selected from the group consisting of fine paper pulp slurries, newsprint pulp slurries, board pulp slurries, towel pulp slurries, and tissue pulp slurries.

11. The composition of claim 1, wherein the functional promoter and the polyamide strength resin component are present at a functional promoter-to-polyamide strength component ratio ranging from about 1/20 to about 1/1.

12. A paper product comprising the reaction product of:

(a) a polyamide strength resin component, (b) a fibrous substrate component, and (c) a functional promoter comprising a water-soluble anionic polymer having a molecular weight ranging from at least about 50,000 daltons to about 500,000 daltons and a molecular weight charge index value of at least about 10,000;

wherein when functional promoter is used in conjunction with the polyamide strength resin agent in a pulp slurry during a papermaking process, the resulting composition imparts improved wet strength to a paper product made by the papermaking process as compared to when the the polyamide strength resin component is used in conjunction with a water-soluble anionic polymer that does not have a molecular weight that is at least about 50,000 daltons and a molecular weight charge index value that is at least about 10,000.

13. The paper product of claim 12, wherein the functional promoter has a molecular weight ranging from about 50,000 to about 250,000 daltons.

14. The paper product of claim 12, wherein the functional promoter has a molecular weight ranging from about 50,000 to about 100,000 daltons.

15. The paper product of claim 12, wherein the functional promoter has a molecular weight ranging from about 300, 000 to about 500,000.

16. The paper product of claim 12, wherein the functional promoter has a molecular weight charge index value ranging from about 10,000 to about 100,000.

17. The paper product of claim 12, wherein the functional promoter has a molecular weight charge index value ranging from about 25,000 to about 100,000.

18. The paper product of claim 12, wherein the functional polymer is solution.

19. The paper product of claim 12, wherein the molecular weight of the functional promoter is less than 5,000,000.

20. The paper product of claim 12, wherein the functional promoter is selected from the group consisting of copolymers of acrylamide-acrylic acids, copolymers of methacrylic acid, copolymers having alkyl acrylates and acrylic acid, copolymers of alkyl methacrylates and acrylic acid, anionic hydroxyalkyl acrylate copolymers, hydroxy alkyl methacrylate copolymers, copolymers of alkyl vinyl ethers and acrylic acid, anionic polymers made by hydrolyzing an acrylamide polymer, anionic polymers made by polymerizing (i) (methyl)acrylic acid, (II) (methyl)acrylic acid salts, (III) 2-acrylamido-2-methylpropane sulfonate, (iv) sulfoethyl-(meth)acrylate, (iv) vinylsulfonic acid, (v) styrene sulfonic acid, (vi) dibasic acids, (vii) salts of the foregoing monomers, and mixtures thereof, and anionic polymers made with crosslinking agents.

21. The paper product of claim 12, wherein the paper product is a board paper product.

22. The paper product of claim 12, wherein the functional promoter and the polyamide strength resin component are present at a functional promoter: polyamide strength resin component ratio ranging from about 1/20 to about 1/1.

23. A method for making a paper product comprising (1) adding to a pulp slurry containing a fibrous substrate component a composition comprising:

(a) a functional promoter comprising a water-soluble anionic polymer having a molecular weight of at least about 50,000 daltons to about 500,000 daltons and a molecular weight charge index value of at least about 10,000, and (b) a polyamide strength resin component, and (2) forming a paper product from the slurry, wherein the composition imparts improved wet strength to the paper product made as compared to when the polyamide strength resin component is used in conjuncture with a water-soluble anionic polymer that does not have a molecular weight that is at least about 50,000 daltons and a molecular weight charge index value that is at least about 10,000.

24. The method of claim 23, wherein the functional promoter has a molecular weight ranging from about 50,000 to about 250,000 daltons.

25. The method of claim 23, wherein the functional promoter has a molecular weight ranging from about 50,000 to about 100,000 daltons.

26. The method of claim 23, wherein the functional promoter has a molecular weight charge index value ranging from about 10,000 to about 100,000.

27. The method of claim 23, wherein the functional promoter has a molecular weight charge index value ranging from about 25,000 to about 100,000.

28. The method of claim 23, wherein the functional promoter is in solution.

29. The method of claim 23, wherein the functional promoter is selected from the group consisting of copolymers of acrylic acid, copolymers of acrylamide-acrylic acids, copolymers of methacrylic acid, copolymers having alkyl acrylates and acrylic acid, copolymers of alkyl methacrylates and acrylic acid, anionic hydroxyalkyl acrylate copolymers, hydroxy alkyl methacrylate copolymers, copolymers of alkyl vinyl ethers and acrylic acid, anionic polymers made by hydrolyzing an acrylamide polymer, anionic polymers made by polymerizing (I) (methyl)acrylic acid, (H) (methyl)acrylic acid salts. (iii) 2-acrylamido-2-methylpropane sulfonate, (iv) sulfoethyl-(meth)acrylate, (iv) vinylsulfonic acid, (v) styrene sulfonic acid, (vi) dibasic acids, (vii) salts of the foregoing monomers, and mixtures thereof, and anionic polymers made with crosslinking agents.

30. The method of claim 23, wherein the fibrous substrate component is selected from the group consisting of fine paper pulp slurries, newsprint pulp slurries, board pulp slurries, towel pulp slurries, and tissue pulp slurries.

31. The method of claim 23, wherein the fibrous substrate is a board pulp slurry.

32. The method of claim 23, wherein the functional promoter and the polyamide strength resin component are present at a functional promoter: cationic strength component ratio ranging from about 1/20 to about 1/1.

33. The method of claim 23, wherein the functional promoter is added to the slurry at a dosage of at least about 0.1 lb/ton and the cationic strength component is added to the slurry at a dosage of at least about 0.1 lb/ton.

* * * * *